US009332372B2

(12) United States Patent
Meyer

(10) Patent No.: US 9,332,372 B2
(45) Date of Patent: May 3, 2016

(54) VIRTUAL SPATIAL SOUND SCAPE

(75) Inventor: Laurens Meyer, Richmond (AU)

(73) Assignee: International Business Machines Corporation, Armonk, NY (US)

( * ) Notice: Subject to any disclaimer, the term of this patent is extended or adjusted under 35 U.S.C. 154(b) by 756 days.

(21) Appl. No.: 12/794,961

(22) Filed: Jun. 7, 2010

(65) Prior Publication Data

US 2011/0299707 A1 Dec. 8, 2011

(51) Int. Cl.
*H04S 7/00* (2006.01)

(52) U.S. Cl.
CPC ..... *H04S 7/304* (2013.01)

(58) Field of Classification Search
CPC ..... H04S 2420/01; H04S 7/302–7/306; H04S 7/30; H04S 7/004; H04S 1/005; H04S 2400/11; H04S 3/004; H04R 5/033; H04M 3/568; G06F 3/0346; G06F 3/04815
USPC ..... 381/309–311, 74
See application file for complete search history.

(56) References Cited

U.S. PATENT DOCUMENTS 3,962,543 A 6/1976 Blauert et al.
4,081,606 A 3/1978 Gerzon
5,438,623 A 8/1995 Begault
5,452,359 A 9/1995 Inanaga et al.
5,819,206 A * 10/1998 Horton et al. ..... 702/150
5,844,816 A 12/1998 Inanaga et al.
6,021,206 A 2/2000 McGrath
6,370,256 B1 4/2002 McGrath
6,961,439 B2 11/2005 Ballas
7,116,789 B2 10/2006 Layton
7,155,025 B1 12/2006 Weffer
7,167,567 B1 * 1/2007 Sibbald et al. ..... 381/310

(Continued)

FOREIGN PATENT DOCUMENTS

EP 2031418 4/2009
WO WO2005032209 4/2005
WO WO2006052188 5/2006

OTHER PUBLICATIONS

Notification of Transmittal of the International Search Report and the Written Opinion of the International Searching Authority, or the Declaration for related PCT application, PCT/EP/2011/058725, 11 pages.

(Continued)

*Primary Examiner* — Ping Lee
(74) *Attorney, Agent, or Firm* — Law Offices of Ira D. Blecker, P.C.

(57) ABSTRACT

An apparatus, method and computer program product relating to spatialized audio. There is a set of headphones having an accelerometer and a tilt sensor for tracking the location and orientation of the set of headphones and a computer apparatus which includes a headphone position processor to receive headphone location and orientation information from the set of headphones, virtual speaker location processors (VSLPs) which receive a digital signal containing audio information from a digital audio stream and a digital signal containing headphone location and orientation information from the headphone position processor and output a digital signal containing audio information, a summing processor to receive the digital output signals from the VSLPs, sum them and output them to a digital to analog (D/A) converter. The D/A converter converts the summed digital output signals received from the VSLPs to an analog signal and outputs the analog signal to the set of headphones.

11 Claims, 4 Drawing Sheets

(56) References Cited

U.S. PATENT DOCUMENTS

| | | | | |
|---|---|---|---|---|
| 7,203,327 | B2 | 4/2007 | Kubota | |
| 7,333,622 | B2 | 2/2008 | Algazi | |
| 7,415,123 | B2 | 8/2008 | Ballas | |
| 7,532,734 | B2 | 5/2009 | Pham et al. | |
| 2002/0071661 | A1 | 6/2002 | Nakano et al. | |
| 2003/0031334 | A1* | 2/2003 | Layton et al. | 381/310 |
| 2006/0045294 | A1* | 3/2006 | Smyth | 381/309 |
| 2006/0277034 | A1* | 12/2006 | Sferrazza | 704/200.1 |
| 2007/0172086 | A1* | 7/2007 | Dickins et al. | 381/309 |
| 2009/0052703 | A1* | 2/2009 | Hammershoi | 381/310 |
| 2009/0058606 | A1 | 3/2009 | Munch et al. | |
| 2009/0097689 | A1 | 4/2009 | Prest et al. | |
| 2010/0150355 | A1* | 6/2010 | Kon et al. | 381/17 |

OTHER PUBLICATIONS

Heller, Florian, "CORONA Realizing an Interactive Experience in Visually Untouchable Rooms Using Continuous Virtual Audio Spaces", Thesis, Computer Science Department, RWTH Aachen University, pp. 35-45 (2008).

Tanaka, Atau, "Visceral Mobile Music Systems", 2008, 16 pages.

Sonic City (2002-2004), Future Applications Lab-Viktoria Institute, 1 page.

Boubezari, Mohammed et al., "Spatial representation of soundscape", Acoustical Society of America Journal, vol. 115, Issue 5, p. 2453 (2001).

"What is in a sound?", Andromeda Blog (2008), 3 pages.

* cited by examiner

VIRTUAL SPATIAL SOUND SCAPE

BACKGROUND OF THE INVENTION

The present invention relates to the field of audio processing and, more particularly, to the field of processing spatialized audio so that when the audio is reproduced into a set of headphones, the audio appears to be coming from a certain direction.

Headphones used for listening to audio typically have dual earpieces for listening to left and right audio channels. The headphones work fine when there is a two channel audio feed as one channel is sent to the left audio channel for listening by the left ear and the other channel is sent to the right audio channel for listening by the right ear.

However, the headphones do not work correctly when there are more than two audio channels as the various channels are mixed down to a single left and right pair of audio channels. For example, in a sound scape where there are sounds on the left, right, front and rear, all of those sounds would be mixed down to left and right audio channels. Thus, the audio reproduced by the headphones would not be an accurate representation of the three dimensional sound scape.

Moreover, current headphones do not take into account that the user wearing the headphones may move around so that the user's location within the sound scape is not accurately reproduced by the headphones.

BRIEF SUMMARY OF THE INVENTION

The various advantages and purposes of the present invention as described above and hereafter are achieved by providing, according to a first aspect of the invention, an apparatus for spatialized audio which includes: a set of headphones for placing on the head of a user, the headphones having an accelerometer and a tilt sensor for tracking the location and orientation of the set of headphones; a headphone position processor to receive headphone location and orientation information from the set of headphones; a plurality of virtual speaker location processors (VSLPs), each VSLP having a first input channel to receive a digital signal containing audio information from a digital audio stream, a second input channel to receive a digital signal containing headphone location and orientation information from the headphone position processor, and an output channel to output a digital signal containing audio information comprising the digital audio stream as modified by the headphone location and orientation information; a summing processor having an input channel to receive the digital output signals from the VSLPs, a summing function to sum the digital output signals received from the VSLPs, and an output channel to output the summed digital output signals received from the VSLPs; and a digital to analog (D/A) converter to receive the summed digital output signals received from the VSLPs and convert the summed digital output signals received from the VSLPs to an analog signal and output the analog signal to the set of headphones.

According to a second aspect of the invention, there is provided an apparatus for spatialized audio which includes: a set of headphones for placing on the head of the user, the headphones having a left earpiece and a right earpiece for receiving left and right, respectively, analog audio signals, each earpiece having an accelerometer and a tilt sensor for tracking the location and orientation of each earpiece; a headphone position processor to receive headphone location and orientation information from the headphones; a plurality of left side virtual speaker location processors (VSLPs), each left side VSLP having a first input channel to receive a digital signal containing left side audio information from a digital audio stream, a second input channel to receive a digital signal containing left earpiece location and orientation information from the headphone position processor, and an output channel to output a digital signal containing left side audio information comprising the left side digital audio stream as modified by the left earpiece location and orientation information; a plurality of right side virtual speaker location processors (VSLPs), each right side VSLP having a first input channel to receive a digital signal containing right side audio information from a digital audio stream, a second input channel to receive a digital signal containing right earpiece location and orientation information from the headphone position processor, and an output channel to output a digital signal containing right side audio information comprising the right side digital audio stream as modified by the right earpiece location and orientation information; a summing processor having a first input channel to receive the left side digital output signals from the VSLPs, a summing function to sum the left side digital output signals received from the VSLPs, and a first output channel to output the summed left side digital output signals received from the VSLPs, and a second input channel to receive the right side digital output signals from the VSLPs, a summing function to sum the right side digital output signals received from the VSLPs, and a second output channel to output the summed right side digital output signals received from the VSLPs; a first digital to analog (D/A) converter to receive the summed left side digital output signals received from the VSLPs and convert the summed left side digital output signals received from the VSLPs to a left side analog signal and output the left side analog signal to the left earpiece of the headphones; and a second digital to analog (D/A) converter to receive the summed right side digital output signals received from the VSLPs and convert the summed right side digital output signals received from the VSLPs to a right side analog signal and output the right side analog signal to the right earpiece of the headphones.

According to a third aspect of the invention, there is provided a method for spatialized audio using an apparatus comprising a set of headphones having an accelerometer and a tilt sensor. The method includes the steps of: tracking the location and orientation of the set of headphones with the accelerometer and tilt sensor; receiving by a computer processor a digital signal containing audio information from a digital audio stream and a digital signal containing location and orientation information from the set of headphones and outputting by a computer processor digital output signals containing audio information comprising modifying the digital audio stream by the location and orientation information from the set of headphones; receiving by a computer processor the digital output signals; summing by a computer processor the digital output signals to result in a summed digital signal; outputting by a computer processor the summed digital signal; and receiving by a computer processor the summed digital signal, converting by a computer processor the summed digital signal to an analog signal and outputting the analog signal to the set of headphones.

According to a fourth aspect of the invention, there is provided a computer program product for spatializing audio using an apparatus comprising a set of headphones having an accelerometer and a tilt sensor. The computer program product includes a computer readable storage medium having computer readable program code embodied therewith. The computer readable program code includes: computer readable program code configured to track the location and orientation of the set of headphones; computer readable program code configured to receive a digital signal containing audio information from a digital audio stream and a digital signal containing location and orientation information from the set of headphones and outputting digital output signals containing audio information modified by the digital audio stream by the location and orientation information from the set of headphones; computer readable program code configured to sum the digital output signals to result in a summed digital signal; computer readable program code configured to output the summed digital signal; and computer readable program code configured to receive the summed digital signal, convert the summed digital signal to an analog signal and output the analog signal to the set of headphones.

BRIEF DESCRIPTION OF THE DRAWINGS

The features of the invention believed to be novel and the elements characteristic of the invention are set forth with particularity in the appended claims. The Figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE INVENTION

As noted above, using headphones to listen to anything more than a two channel audio feed doesn't work correctly as all the various channels need to be mixed down to a single left and right pair of audio channels. This means that you lose the extra spatial components that would be provided by the rear and any side channels. It also means that as you move around an area, the soundscape stays static. That is, the sound scape moves with you instead of you moving within it.

Three differences can be used to determine the direction of a sound source from a pair of ears.

1. Amplitude—The sound will be louder in the closer ear
2. Phase difference—The sound will arrive earlier in the closer ear
3. Frequency—The shape of the ear and the position of the head between the ear and the sound source will change the frequency envelope.

Figure 1:
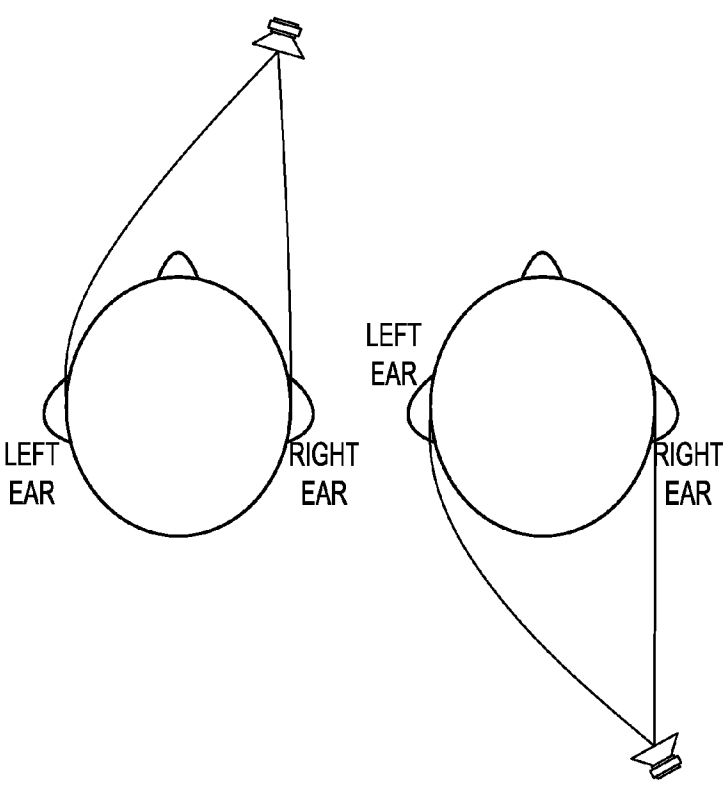
FIG. 1 is a graphical representation of paths from sound sources in front of and behind a user's head.

The problem is that because a headphone user only has two ears, it is difficult to determine if the source is in front of the headphone user or behind the headphone user. This is illustrated in FIG. 1. In both examples shown in FIG. 1, the paths from the sound sources (represented as speakers) to each of the corresponding ears is the same length so the amplitude and phase difference will be the same. In both examples, the sound reaches the right ear first.

To help detect the difference between a front located sound source and a rear located sound source, the shape of the human ear provides a frequency filtering function which is commonly referred to as a Head-Related Transfer Function (HRTF). The HRTF for sounds to the side and front of the ear pass higher frequencies than the HRTF for sounds behind the ear due to the shape of the outer ear (pinna).

The HRTF is determined by the distance, horizontal angle, vertical angle and frequency of the sound source to each of the ears. Further, the HRTF varies between individuals due to the difference in head and ear shape. However, HRTFs can be determined for a dummy head of idealized geometry as is commonly done in practice. The methods of calculating HRTFs are well known to those skilled in the art.

The other method that is used to determine front/back direction is subtle head movements to shift the ears in relation to the source; this can be seen in the process of cocking a head used by humans and some animals. This head movement allows the time difference from a fixed position sound source to be changed in a known manner. In the example in FIG. 1, if the head is rotated left then for a frontal sound source the path to the right ear shortens and the path the left ear lengthens. For a rear source the effect is reversed. So a quick, small rotation of the head can immediately provide information that the source is in front or behind.

Existing methods that attempt to provide a sound scape by changing the time differences and using a different HRTF for each channel as it is down mixed to a left and right pair may not work well as it does not allow discrimination between front and back channels by head movement. The sound scape is fixed to the headphone position so that the sound scape moves with the headphone wearer when the headphone wearer moves.

Therefore, the only way to successfully provide a full 3-dimensional (3D) spatial sound scape is to comprehensively track the subtle head movements and to use the position and velocity information of the sound source to create left and right channel inputs from each sound source. This also allows the user to move through a fixed sound scape. That is, the virtual speakers are fixed in position and the user can move around the virtual speakers in a 3D world.

The present invention pertains to an apparatus, method and computer program product for spatialized audio.

Figure 2:
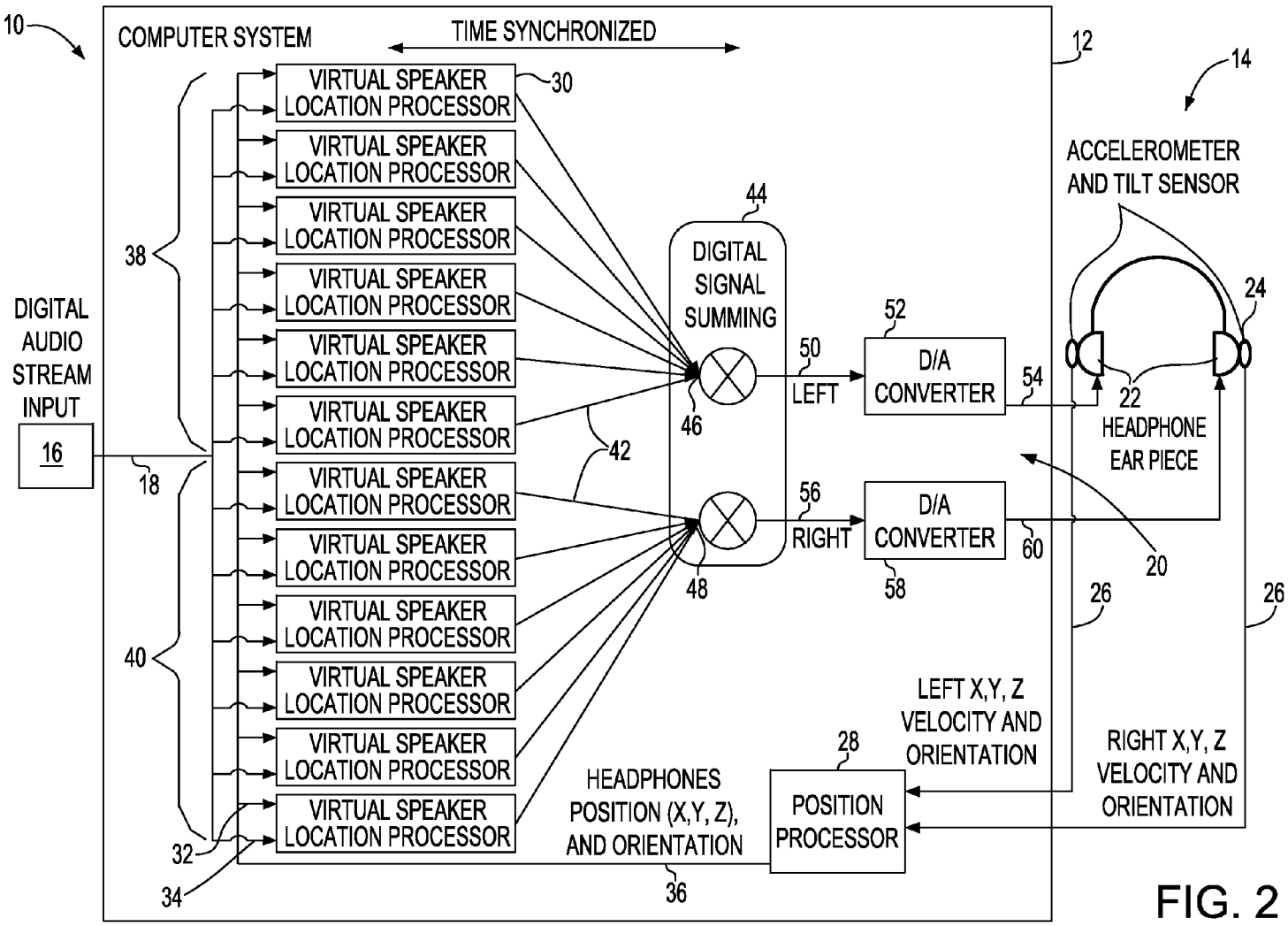
FIG. 2 is a schematical representation of an apparatus for practicing the present invention.

Referring now to FIG. 2, there is shown an apparatus 10 for practicing the present invention. The apparatus 12 comprises a computer system 12 and headphones 14. The computer system 12 could be a general purpose computer, for example a home computer, or an embedded computer as part of a home theater system or television. A digital audio stream 16 is input 18 by a plurality of input channels to the computer system 12, processed by the computer system 12 and then output 20 as left and right analog signals to the headphones 14.

The digital audio stream would be either the feed from a media package running on the computer system 12 or an external digital source. The digital audio stream may be, for example, a compact disc, a digital video disc, digital television, etc.

The headphones 14 include at least one accelerometer and tilt sensor but it is preferred that there be one accelerometer and one tilt sensor per earpiece 22 of the headphones. A set of headphones having only one accelerometer and one tilt sensor in one earpiece may work well with far away sound sources as the approximate location and orientation of the second earpiece may be determined from the first earpiece. This is not the most preferred apparatus since a set of headphones fits on user's heads in different ways which will affect the sound scape if only one accelerometer and one tilt sensor in one earpiece is used. For the best spatialized sound scape, it is preferred that there be one accelerometer and one tilt sensor in each earpiece so that the location and orientation of each earpiece is accurately known.

The accelerometer and tilt sensor can be conveniently located in housing 24 of each earpiece 22. The accelerometers and tilt sensors are available as microchips from companies such as Analog Devices (Norwood, Mass.) and Crossbow Technology (Milpitas, Calif.).

With the state of digital signal processing and the availability of high quality microchip digital accelerometers and tilt sensors, the present invention preferably carries out all of the processing digitally and only carries out the digital to analog conversion as the signals are output to the headphones.

The accelerometer and tilt sensor are used to accurately obtain the relative location and orientation of the headphones. The accelerometer is a 3-axis accelerometer used to obtain the X,Y,Z location of the headphones while the tilt sensor obtains the orientation of the headphones, that is, whether they are tilted or not. The accelerometer and tilt sensor output 26 signals indicating the location and orientation of the headphones 14 to a position processor 28 in computer system 12. The position processor 28 tracks the location and orientation of each of the headphone earpieces. The velocity of movement of the headphones 14 is used in determining the location and orientation of the headphones 14 as the headphones 14 are moved from point A to point B in a given unit of time. Processing the output from an accelerometer alone would provide enough information to track the tilt of the headphones 14, but during initialization (below), the accelerometers cannot determine the orientation of the headphones 14 while the tilt detectors can. Once the initial position of the headphones 14 has been set the accelerometers and tilt sensors would be used together.

The accelerometers can only determine relative movement from point A to point B so there has to be some mechanism for initialization of the location and orientation of the headphones 14. There are several means for setting an initial location and orientation of the headphones 14. When the headphones are used, they may need to have an initial position set.

One option would be to provide automatic initial position detection of the headphones 14. The headphones 14 would be placed in a specific "Home" location, for example, just in front of a video screen and the computer system 12 powered up. The computer system 12 and headphones 14 would then initialize the location and orientation of the headphones and use that as the "Home" location. From that point on, as the headphones 14 were moved the location and orientation of the headphones 14 relative to their initial location and orientation would be tracked by the accelerometers and tilt sensors. The location and orientation of the headphones 14 would need to be tracked while the computer system 12 was in standby mode. This option may not be the best approach since the computer system 12 may not know when the initial position should be set. For example, if the audio system is shutoff and the headphones are moved while the system is off, the computer system 12 would lose track of the physical position of the headphones 14. When the computer system 12 is turned on and the headphones are picked up and placed on the user's head, at what point should the computer system 12 set an initial position?

Another option is to use a system wherein the physical location of the headphones 14 with respect to the computer system 12 is determined using infrared or ultrasonic signals and the tilt detector in the headphones 14. The infrared or ultrasonic signals may be emitted under the control of the computer system 12, for example, from a pair of external devices, mounted on the top corners of a computer screen, television screen or the front left and right speakers This option also may not be the best option as the user would always need to sit in the sweet spot to get the best spatial effect.

The preferred option is to allow the user to locate themselves where they want to listen and then to push a button either on a remote control or on the headphones 14. The action of pushing the button on the remote control or on the side of the headphones 14 would send a signal (preferably wirelessly) to the computer system 12, The exact detail of the signal would depend on the protocol used to communicate between the headphones 14 and the computer system 12 or the remote control and the computer system 12. The computer system 12 would then reset the virtual location of the listener to the sweet spot. This process could be repeated if the user moved to reset the sweet spot. The tilt sensors in the headphones 14 would be used to set the initial orientation.

The computer system 12 further includes a plurality of virtual speaker location processors (VSLPs) 30. Each of the VSLPs 30 would be configured with the input channel, output channel and virtual location (X, Y, Z) of the speaker it is emulating. The VSLPs 30 take the headphones location and orientation and creates a feed for the left or right output channel based on the virtual speaker location and the listeners' head position, adjusting the time delay and frequency spectrum based on the position of the ear in relationship to the virtual speaker location. The VSLPs 30 are divided into two groups, one group 38 for the left ear and one group 40 for the right ear. Each of the VSLPs 30 would have an input channel 32 to receive input 36 from the position processor 28 and another input channel 34 to receive input 18 from the digital audio stream 16. The digital audio stream 16 has a plurality of input channels from the multiple audio components. Each input channel from the digital audio stream 16 is sent to two VSLPs 30, one (in group 38) for the left ear and one (in group 40) for the right ear.

The VSLPs 30 each have an output channel 42 to output audio information to the summer 44. Outputs from the left ear VSLPs 38 are sent to input channel 46 of summer 44 while outputs from the right ear VSLPs 40 are sent to input channel 48 of summer 44. Each of the data feeds from the VSLPs 30 must contain a time stamp. The summer 44 will use these time stamps to make sure that the left and right channels are assembled correctly. The time synchronisation is required because a specific sound such as a single musical instrument or person speaking may be encoded into more than one input channel to locate them in position midway between two virtual speakers.

The digital summer 44 sums the digital signals received in input channel 46 from the left VSLPs 38 and outputs 50 the summed digital signal to left ear digital/analog (D/A) converter 52 which in turn outputs 54 a left ear analog signal to headphones 14. Similarly, digital summer 44 sums the digital signals received from the right VSLPs 40 and outputs 56 the summed digital signal to right ear D/A converter 58 which in turn outputs 60 a right ear analog signal to headphones 14.

Figure 4:
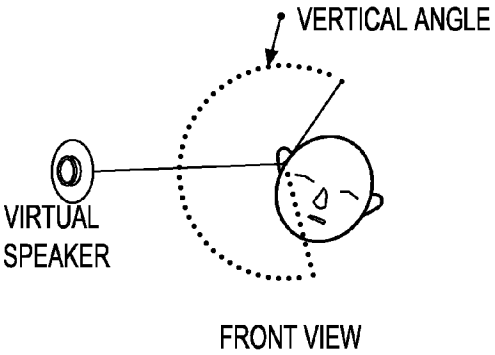
FIG. 4 is a graphical representation of a vertical angle between a user and a virtual speaker.
Figure 5:
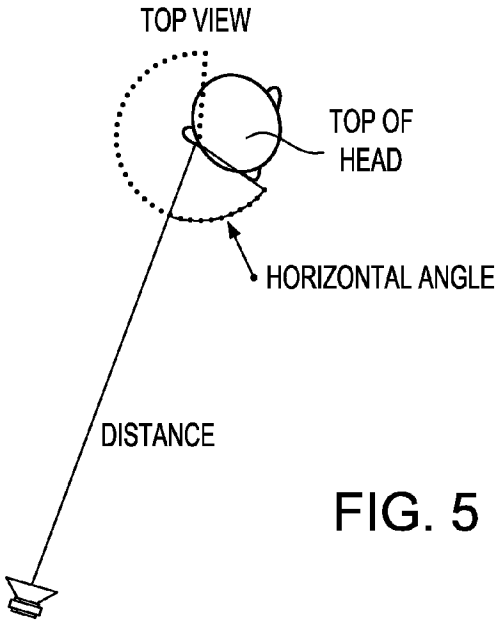
FIG. 5 is a graphical representation of a horizontal angle and the distance between a user and a virtual speaker.
Figure 3:
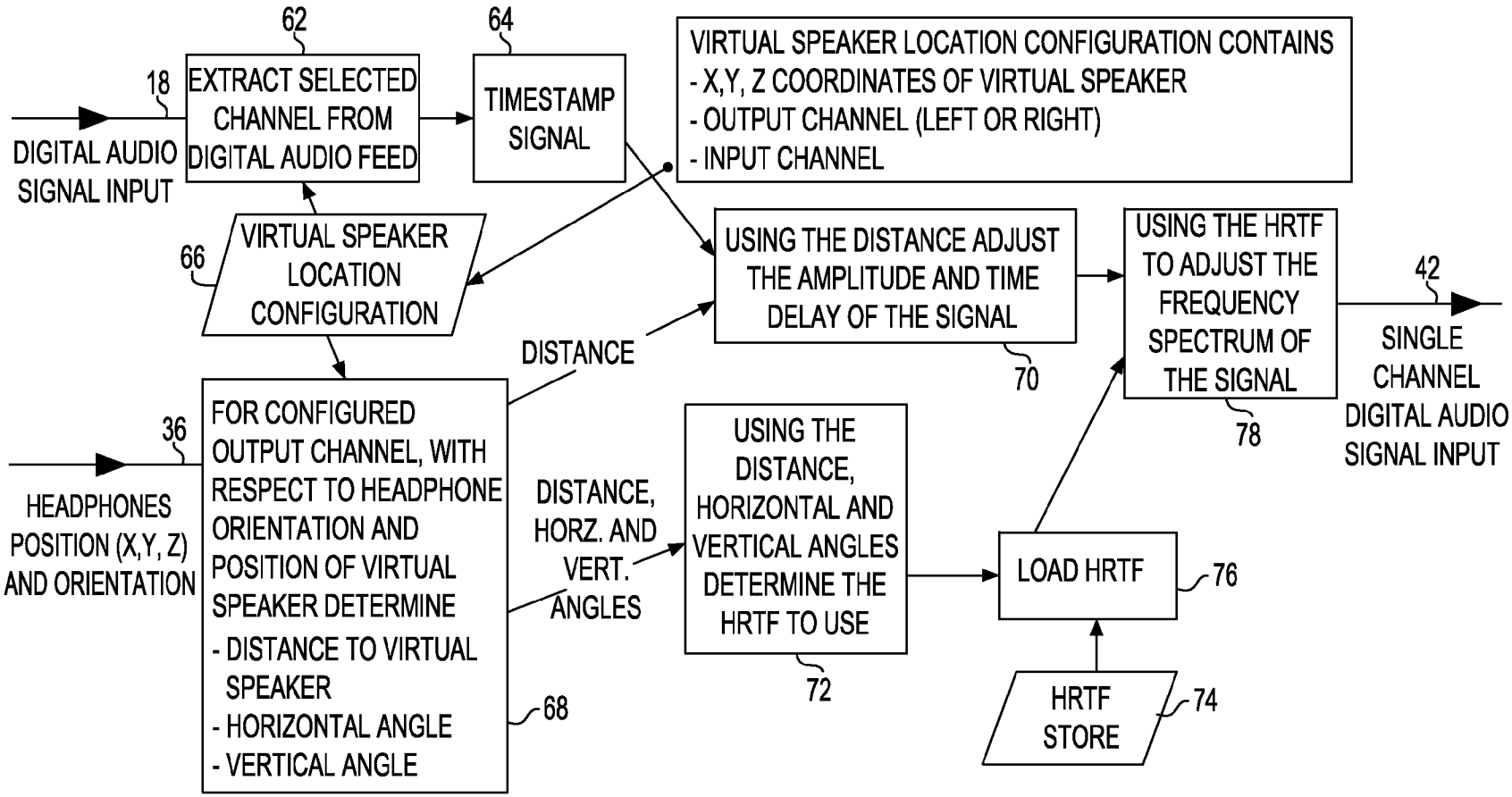
FIG. 3 is a diagram representing the functions of a Virtual Speaker Location Processor (VSLP) according to the present invention.

The functions of the VSLPs 30 are described in more detail with respect to FIGS. 3 to 5. The headphone location and orientation data from position processor 28 is combined with the virtual speaker location configured in the VSLPs 30 and output channel 42 to determine the distance between the ear and virtual speaker location and the horizontal and vertical angles relative to the head. FIG. 4 illustrates the vertical angle between the headphone user and the virtual speaker. FIG. 5 illustrates the horizontal angle between the headphone user and the virtual speaker and the distance between the ear of the headphone user and the virtual speaker. All the distances are a relative distance calculated from the initial position. The relative distance of each ear from the initial position and the distances of the virtual speakers from the initial position are used to calculate an X,Y,Z distance from the ear to each of the virtual speakers as the person moves around the room.

In a physical surround sound system, the owner's manual gives sample room layouts for placement of the speakers. The room layout would change based on whether the sound system is stereophonic, quadraphonic, 3.1, 5.1, 6.1, 7.1, etc. audio format. An initial position of the speakers could be having the speakers arranged in a 4.5 meter circle around the user. In the present invention, the initial position of the user with respect to the virtual speakers is set as a default to the perfect location for each particular audio format. Perfect configurations for each of the audio formats would be set in the VSLPs 30. For example, for a quadraphonic arrangement, the virtual speakers would be spaced at 45, 135, 225 and 315 degrees around the user at a distance of 4.5 meters from the user and thus the initial position of the user would be 4.5 meters from each virtual speaker. As the user moves through the virtual sound scape, the relative location and orientation of the user with respect to the initial position would be measured by the accelerometers and the tilt sensors so that it would appear as if the user is moving through the sound scape rather than with the sound scape.

The physical and virtual locations of the speakers can be exactly the same. However, for the use of headphones the logical locations can be defaulted to what is considered the best physical locations. For example, for a home theater sound system, the manufacturer always suggests the best location for each of the speakers. These would be the best locations for the virtual locations and if this was to be part of a home theater appliance then these locations could be preconfigured as the default.

Specifically referring now to FIG. 3, digital audio signal input 18 is fed into each VSLP 30. A digital audio stream normally contains all the channels as separate components. The VSLP 30 uses the input channel configuration parameter to determine which data to extract. In a digital sound system all of the input channels are sent in the one digital stream. The configuration parameter is used to select the required channel. For example, a 5.1 sound stream may have the following channels: Front Left, Front Center, Front Right, Back left, Back Right and subwoofer. Each of the VSLPs 30 would select just one of these channels. So for those six channels, there would be 12 VSLPs 30, one for each channel for each ear. Each VSLP 30 configuration includes the left or right channel of the virtual speaker as well as the X,Y,Z coordinates of the virtual speaker, as indicated in box 66. Channel information is extracted from the digital audio feed as indicated in box 62 and the signal is time stamped, box 64, for proper assembly later on. The VSLP 30 receives 36 headphone location and orientation information from which is determined, in conjunction with the virtual speaker location configuration, box 66, the distance to the virtual speaker (FIG. 5), the horizontal angle (FIG. 5) and the vertical angle (FIG. 4). Using the distance so determined in box 68 and combining with the timestamped signal from box 64, the amplitude (loudness) and time delay of the signal are adjusted in box 70.

Further, using the distance, horizontal angle and vertical angle determined in box 68, the proper HRTF is determined for use. The HRTF is a frequency map. The VSLP 30 will store, as shown in box 74, all the necessary HRTFs which have been previously calculated. In one embodiment, there will be a table of HRTFs and the most appropriate HRTF will be selected when all the values from box 68 are entered into the table. In one embodiment, there may be a different HRTF for each 5 degree orientation of the head of the user. Once selected, the HRTF will be loaded as indicated in box 76.

As shown in box 78, the HRTF will be used to adjust the frequency spectrum of the signal in box 70 and then outputted 42 to the digital summer 44.

The VSLPs could be any computer processor, suitably programmed, that could process the various functions of the VSLPs.

In one embodiment, the VSLPs 30, position processor 28, digital summer 44 and D/A converters 52, 58 could be separate computer processors. In another embodiment, the VSLPs 30, position processor 28, digital summer 44 and D/A converters 52, 58 may be carried out as tasks with a multi-core computer processor. Both embodiments are considered within the scope of the present invention.

Figure 6:
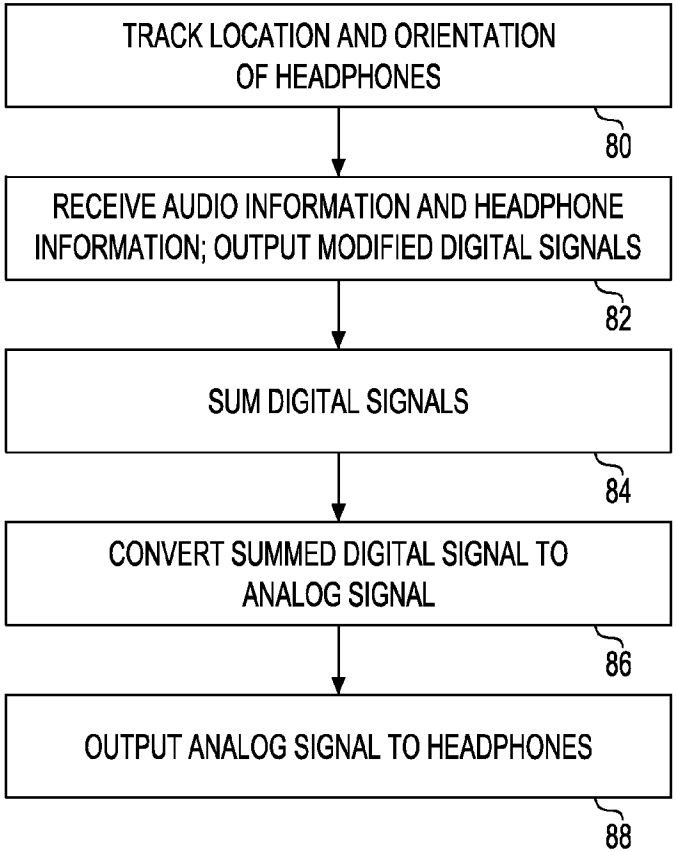
FIG. 6 is a flow chart illustrating an implementation of the method of the present invention.

Referring now to FIG. 6, the method of the present invention will be discussed. In the method of the present invention, a set of headphones including an accelerometer and a tilt sensor are utilized. The steps of the invention may be carried out by multiple computer processors or a single multi-core processor as indicated above. In a first step of the method, the location and orientation of the set of headphones are tracked using the accelerometer and tilt sensor, as indicated in box 80. The headphone location and orientation and a digital signal audio stream having audio information for multiple channels are received and a digital signal containing audio information as modified by the location and orientation information from the set of headphones is outputted for each of the channels, as indicated by box 82. The outputted digital audio signal is summed and outputted, box 84, and then converted to an analog signal, as indicated by box 86. In the final step of the method, the analog signal is outputted to the set of headphones, as indicated in box 88.

According to the apparatus, method and computer program product of the present invention, a listener using a set of headphones may hear a three-dimensional sound scape as well as being able to move within that sound scape. The present invention has applicability to current audio formats as well as virtual reality environments and computer gaming where the user would move within the sound scape.

Figure 7:
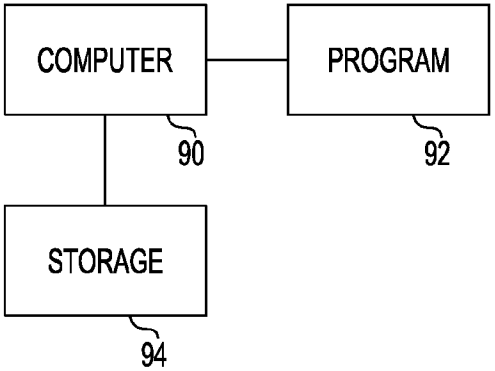
FIG. 7 is a block diagram illustrating an exemplary hardware environment of the present invention.

FIG. 7 is a block diagram that illustrates an exemplary hardware environment of the present invention. The present invention is typically implemented using a computer 90 comprised of microprocessor means, random access memory (RAM), read-only memory (ROM) and other components. The computer may be a personal computer, mainframe computer or other computing device. Resident in the computer 90, or peripheral to it, will be a storage device 94 of some type such as a hard disk drive, floppy disk drive, CD-ROM drive, tape drive or other storage device.

Generally speaking, the software implementation of the present invention, program 92 in FIG. 7, is tangibly embodied in a computer-readable medium such as one of the storage devices 94 mentioned above. The program 92 comprises instructions which, when read and executed by the microprocessor of the computer 90 causes the computer 90 to perform the steps necessary to execute the steps or elements of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described above in with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It will be apparent to those skilled in the art having regard to this disclosure that other modifications of this invention beyond those embodiments specifically described here may be made without departing from the spirit of the invention. Accordingly, such modifications are considered within the scope of the invention as limited solely by the appended claims.

I claim:

1. An apparatus for spatialized audio comprising:

a set of headphones for placing on the head of the user, the headphones having a left earpiece and a right earpiece for receiving left and right, respectively, analog audio signals, each earpiece having an accelerometer and a tilt sensor for tracking the location and orientation of each earpiece;

a headphone position processor to receive headphone location and orientation information from the headphones including an initial location and orientation of the set of headphones;

a plurality of left side virtual speaker location processors (VSLPs), each left side VSLP containing the virtual location of a virtual speaker that it is emulating, each left side VSLP having a first input channel to receive a digital signal containing left side audio information from a digital audio stream, each left side VSLP having a second input channel to receive a digital signal containing left earpiece location and orientation information for each left side VSLP from the headphone position processor, and each left side VSLP having an output channel to output a digital signal containing left side audio information comprising the left side digital audio stream as modified by the left earpiece location and orientation information, the left side VSLPs, responsive to receiving left earpiece location and orientation information from the headphone position processor, calculate the distance between the left earpiece location and each of the virtual speakers with respect to the initial location at each and every location and orientation of the left earpiece, the left side VSLPs modify the digital audio stream at each and every location and orientation of the set of headphones with respect to the calculated distance at each and every location and orientation of the set of headphones between each of the left side VSLPs and the set of headphones;

a plurality of right side virtual speaker location processors (VSLPs), each right side VSLP containing the virtual location of a virtual speaker that it is emulating, each right side VSLP having a first input channel to receive a digital signal containing right side audio information from a digital audio stream, each right side VSLP having a second input channel to receive a digital signal containing right earpiece location and orientation information for each right side VSLP from the headphone position processor, and each right side VSLP having an output channel to output a digital signal containing right side audio information comprising the right side digital audio stream as modified by the right earpiece location and orientation information, the right side VSLPs, responsive to receiving right earpiece location and orientation information from the headphone position processor, calculate the distance between the right earpiece location and each of the virtual speakers with respect to the initial location at each and every location and orientation of the right earpiece, the right side VSLPs modify the digital audio stream at each and every location and orientation of the set of headphones with respect to the calculated distance at each and every location and orientation of the set of headphones between each of the right side VSLPs and the set of headphones;

a summing processor having a first input channel to receive the left side digital output signals from the VSLPs, a summing function to sum the left side digital output signals received from the VSLPs, and a first output channel to output the summed left side digital output signals received from the VSLPs, and a second input channel to receive the right side digital output signals from the VSLPs, a summing function to sum the right side digital output signals received from the VSLPs, and a second output channel to output the summed right side digital output signals received from the VSLPs;

a first digital to analog (D/A) converter to receive the summed left side digital output signals received from the VSLPs and convert the summed left side digital output signals received from the VSLPs to a left side analog signal and output the left side analog signal to the left earpiece of the headphones; and a second digital to analog (D/A) converter to receive the summed right side digital output signals received from the VSLPs and convert the summed right side digital output signals received from the VSLPs to a right side analog signal and output the right side analog signal to the right earpiece of the headphones;

wherein the apparatus creates a 3-dimensional sound scape to enable the headphones to move within the sound scape at each and every location and orientation of the set of headphones.

2. The apparatus of claim 1 wherein the VSLPs contain a library of head-related transfer functions.

3. The apparatus of claim 2 wherein the head-related transfer functions are specific to an orientation of a head of the user.

4. The apparatus of claim 3 wherein there is a different head-related transfer function for each 5 degree orientation of the head of the user.

5. The apparatus of claim 1 wherein the VSLPs are configured with a virtual location of each speaker in the digital audio stream and the VSLPs contain a library of head-related transfer functions and wherein the VSLPs use the location of each virtual speaker and location and orientation of each earpiece in the headphones to adjust an amplitude and time delay of the digital output signal and use a selected frequency transfer function to adjust a frequency spectrum of the digital output signal.

6. The apparatus of claim 1 wherein the VSLPs are configured with a virtual location of each speaker in the digital audio stream and wherein the VSLPs use the location of each virtual speaker and location and orientation of each earpiece in the headphones to adjust an amplitude and time delay of the digital output signal.

7. The apparatus of claim 1 wherein the VSLPs contain a library of head-related transfer functions and wherein the VSLPs use a selected head-related transfer function to adjust a frequency spectrum of the digital output signal.

8. The apparatus of claim 1 further comprising means for setting an initial location and orientation of the set of headphones with respect to the left side and right side virtual speakers.

9. The apparatus of claim 8 wherein the means for setting comprises an apparatus for automatically setting the initial location and orientation of the set of headphones with respect to the left side and right side virtual speakers.

10. The apparatus of claim 8 wherein the means for setting comprises an emitter for emitting infrared or ultrasonic signals in conjunction with the tilt detector to set the initial location and orientation of the set of headphones.

11. The apparatus of claim 8 wherein the means for setting comprises a receiver receiving input from a user to indicate the initial location and orientation of the set of headphones.

* * * * *